US007485811B2

(12) United States Patent
Mjelstad

(10) Patent No.: US 7,485,811 B2
(45) Date of Patent: Feb. 3, 2009

(54) DEEP WATER SIGNAL CABLE

(75) Inventor: Einar Mjelstad, Fredrikstad (NO)

(73) Assignee: Nexans, Paris (FR)

( * ) Notice: Subject to any disclaimer, the term of this patent is extended or adjusted under 35 U.S.C. 154(b) by 0 days.

(21) Appl. No.: 11/337,832

(22) Filed: Jan. 23, 2006

(65) Prior Publication Data

US 2006/0201698 A1 Sep. 14, 2006

(30) Foreign Application Priority Data

Feb. 11, 2005 (NO) ..... 20050753

(51) Int. Cl.
*H01B 7/00* (2006.01)

(52) U.S. Cl. ..... 174/113 R; 174/113 C

(58) Field of Classification Search ..... 174/36, 174/110 R, 113 R, 113 C, 115, 116
See application file for complete search history.

(56) References Cited

U.S. PATENT DOCUMENTS 1,427,100 A * 8/1922 Gilbert ..... 72/278
1,940,917 A * 12/1933 Okazaki ..... 174/113 C
1,976,847 A * 10/1934 Gordon et al. ..... 174/112
3,526,086 A * 9/1970 Morgan ..... 138/111
4,196,307 A * 4/1980 Moore et al. ..... 174/47
4,600,268 A * 7/1986 Spicer ..... 385/103
5,444,184 A * 8/1995 Hassel ..... 174/113 R
5,696,295 A * 12/1997 Wulff et al. ..... 568/724
5,902,958 A * 5/1999 Haxton ..... 174/47
6,080,929 A * 6/2000 Fagouri et al. ..... 174/23 C
6,222,130 B1 * 4/2001 Gareis et al. ..... 174/113 C
6,239,363 B1 * 5/2001 Wooters ..... 174/47
6,472,614 B1 10/2002 Dupont et al. ..... 174/705
6,639,152 B2 * 10/2003 Glew et al. ..... 174/113 C
6,943,300 B2 * 9/2005 Ekeberg et al. ..... 174/113 R

FOREIGN PATENT DOCUMENTS

GB 197692 A * 5/1923
GB 2183402 6/1987
NO 168674 11/1984

* cited by examiner

*Primary Examiner*—William H Mayo, III
(74) *Attorney, Agent, or Firm*—Sofer & Haroun, LLP

(57) ABSTRACT

An electrical signal cable having, at least two insulated conductors, wherein each of the insulated conductors is arranged in a groove (2) of a longitudinal central element (1) made of an elastic material which allows the insulated conductors to move in radial direction when the electrical signal cable is exposed to longitudinal tensile stress.

4 Claims, 2 Drawing Sheets

DEEP WATER SIGNAL CABLE

RELATED APPLICATION

This application is related to and claims the benefit of priority from Norwegian Patent Application No. 2005 0753, filed on Feb. 11, 2005, the entirety of which is incorporated herein by reference.

1) Field of the Invention

The present invention relates to improvements in umbilicals particularly umbilicals for use in deep water applications.

2) Background Art

An umbilical consists of a group of one or more types of elongated active umbilical elements, such as electrical cables, optical fiber cables or tubes, cabled together for flexibility and over-sheathed and/or armoured for mechanical strength and ballast.

Umbilicals are used for transmitting power, signals and fluids to and from a subsea installation via the various elongated umbilical elements. An increasingly important use of umbilicals is the transmission of electrical power to electrical devices on the seabed, and depths of up to 2000 meters are common.

Generally the elements are arranged within the umbilical as symmetrically as possible. The cross-section is preferably circular. In order to fill the interstitial voids between the various umbilical elements and obtain the desired circular configuration, filler components may be included within the voids.

Umbilicals have to be able to withstand substantial laying and service loads and load combinations, and perform their functions for an extended design life.

Electrical and/or optical cables are not designed to resist the loads applied to the umbilical. These hoses and tubes, generally made of thermoplastic material are designed merely to resist collapse.

The elements are normally wound in a helical pattern around a central core. The core may be a larger steel tube, or one of the umbilical elements for instance a power cable. With the helically wound elements, such an umbilical under normal conditions will be able to withstand the moderate loads to be applied to it without the addition of substantial armouring layers.

However, under severe conditions such as in use in deep water and/or in dynamic applications increased loads will be applied to the umbilical, due to the weight of the umbilical and to the dynamic movement of water. Strengthening elements and ballast elements have to be added to the umbilical to withstand these loads.

Armoured cables to be supported from an offshore platform are known from GB 2 183 402.

U.S. Pat. No. 6,472,614 discloses an umbilical comprising a plurality of steel tubes helically wound around a core and at least one substantially solid steel rod helically wound around said core, said rod being shaped and sized for absorbing tensile loading on said umbilical. The steel rod is arranged in a void between the steel tubes. The umbilical comprises at least one elongated umbilical element selected from the group consisting of optical fiber cables, electrical power cables and signal cables.

Object of the present invention is to provide a new structure of an electrical signal cable which can be used in dynamic or deep-water application especially in depth of more than 2000 meters. Signal cables usually consist of two insulated conductors stranded together with two filler elements (pair) or four stranded insulated conductors (quad). The pair and the quad are surrounded by a sheath of polymeric material. The signal cables may have an armouring which is known in the cable technology.

One problem, which arises in umbilicals with at least one signal cable for deep-water application is that the copper conductors of the signal cables elongate to the yield limit of the copper. Armouring processes are working very slowly and should be limited to the absolutely necessary layers.

SUMMARY OF THE INVENTION

According to the present invention there is provided a signal cable with at least two insulated conductors wherein each of the insulated conductors is arranged in a groove of a longitudinal central element made of an elastic material, which allows the insulated conductors to move in radial direction when the electrical signal cable is exposed to longitudinal tensile stress. The new structure of the signal cable gives the insulated conductors an "excess length" due to the fact that under load the pitch of the insulated conductors increases while the pitch diameter decreases, when the insulated conductors are stranded.

In a preferred embodiment of the invention the conductor of the signal cable consists of a massive cold-drawn copper wire. Cold-drawing incorporates high tensile strength to the copper wire. As stranding of cold-drawn copper wires to a conductor is difficult because of the hardness of the copper wires a massive wire as the conductor is preferred.

When the grooves are running in parallel to the longitudinal axis of the center element the distance between the insulated conductors decreases under load, but this solution leads to a less "excess length" of the insulated conductors than in the case of stranded conductors.

The grooves have an oval, a nearly circular or a nearly rectangular cross-section. The cross-section of the signal cable should be less than the cross-section of the groove, allowing the signal cable to move within the groove, when the signal cable or the umbilical is bent.

A further advantage of the invention is that the signal cable has a higher degree of flexibility with respect to elongation.

BRIEF DESCRIPTION OF THE DRAWINGS

Other features of the invention will become apparent from the following description of embodiments of the invention, with reference to the accompanying drawings where.

DETAILED DESCRIPTION

Figure 1:
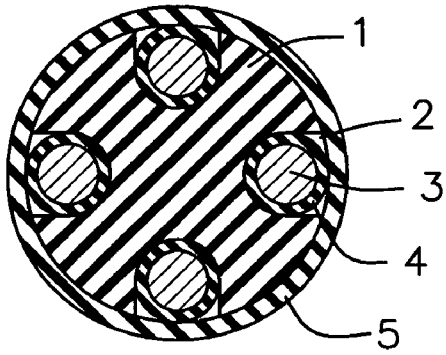
FIG. 1 to FIG. 3 are a schematic transverse sectional views of a signal cable and FIG. 4 is a schematic transverse sectional view of an umbilical.
Figure 2:
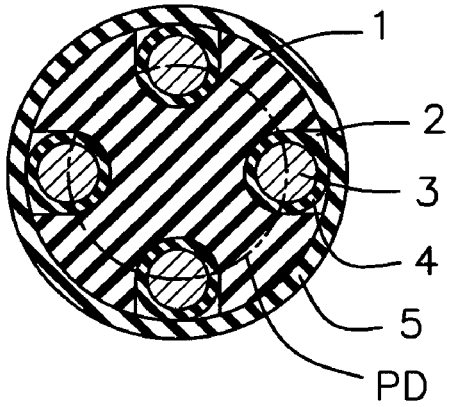
Figure 3:
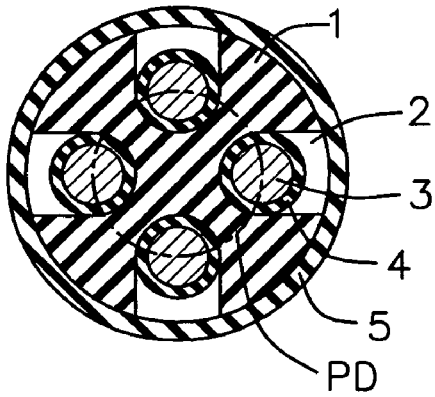

We refer first to FIGS. 1 to 3 showing the construction of a signal cable according to the invention.

A central element 1 made of a flexible or elastic material is provided with several grooves 2, which may be helical or longitudinal with respect to the central axis of the element 1. The element 1 is preferably made by extrusion of an elastic material such as natural or synthetic rubber. We prefer an elastomer such as EPDM. The grooves 2 may be arranged in the element during the extrusion step but may be cut into the extruded element 1.

Into each of the grooves 2 there are laid insulated electrical conductors which consist of a massive and cold drawn copper wire 3 and an insulating layer 4 of polyethylene or another insulating material. The element 1 with the insulated conductors within the grooves 2 is surrounded by a sheath 5 made of polyethylene or another insulated material used in the field of electric cables. The shown signal cable has four insulated conductors, but there may be only two conductors and two fillers instead of the other two conductors.

FIG. 2 shows the signal cable of FIG. 1 when it is without tension. The pitch diameter PD of the conductors is such that there is no outer compression on the element 1.

FIG. 3 shows the signal cable of FIG. 2 when it is under tension, what is the case when the signal cable is used in a deep water umbilical. The pitch diameter PD of the conductors is smaller and the pitch length of the conductors is greater. The insulated conductors move to the center of the element 1 thereby elastically deforming the elastic material of the element 1. By this effect an elongation of the copper conductor to the yield limit is avoided when the signal cable is exposed to higher tensions. A further advantage of the signal cable according to the invention is that the signal cable has a higher degree of flexibility with respect to elongation.

Figure 4:
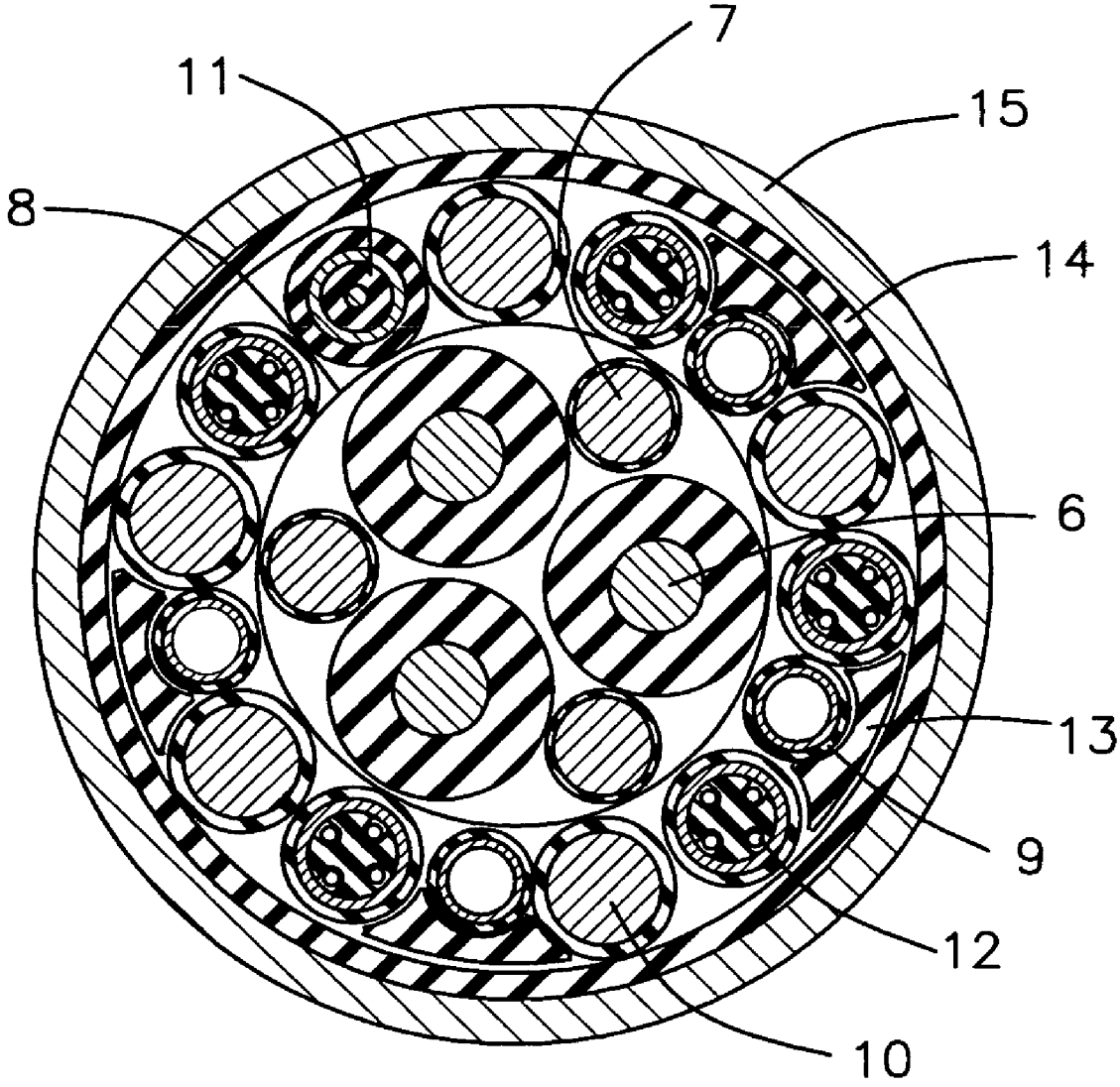

The umbilical shown in FIG. 4 comprises a center core, which consists of three single core power cables 6, which are stranded to a cable bundle. Three steel ropes 7 sheathed with a layer of thermoplastic material are arranged in interstices between the single core power cables 6. The power cables and the steel ropes 7 are surrounded by a wrapping of a steel tape 8 or other tension proof material. Several elements as steel tubes 9, further steel ropes 10 sheathed with polymeric material, a fiber optic cable 11 and signal cables 12 are laid to the surface of the center core. Fillers 13 are arranged between some of the elements.

The outer sheath comprises an inner sheath 14, a steel armouring 15 and an outer layer of polyethylene (not shown). According to the invention the signal cables 12 consist of a central element with grooves in which insulated conductors are situated as described with reference to FIGS. 1 to 3.

The invention claimed is:

1. Umbilical for use in deep water applications comprising:

at least one electrical signal cable; and at least two insulated conductors, wherein each of the insulated conductors is arranged in a groove of a longitudinal central element including an elastic material selected from the group consisting of natural rubber, synthetic rubber or a foamed polymeric material, said insulated conductors having cross sections less than the cross section of said longitudinal grooves for substantially the entire length of said umbilical such that said grooves allow said insulated conductors to move in radial direction when the electrical signal cable is exposed to longitudinal tensile stress, wherein the conductors consist of a cold drawn single conductor.

2. The umbilical according to claim 1, wherein the grooves are running in a helical way.

3. The umbilical according to claim 1, wherein the longitudinal central element includes an elastomer such as EPDM.

4. The umbilical according to claim 1, wherein said cold drawn single conductor is a massive and cold drawn copper wire.

* * * * *